US006834492B2

(12) United States Patent
Hruby et al.

(10) Patent No.: US 6,834,492 B2
(45) Date of Patent: Dec. 28, 2004

(54) AIR BREATHING ELECTRICALLY POWERED HALL EFFECT THRUSTER

(75) Inventors: Vlad Hruby, Newton, MA (US); Bruce Pote, Sturbridge, MA (US); Tom Brogan, Silverthorne, CO (US); Kurt Hohman, Framingham, MA (US); James Szabo, Newton, MA (US); Peter Rostler, Newton, MA (US)

(73) Assignee: Busek Company, Inc., Natick, MA (US)

( * ) Notice: Subject to any disclaimer, the term of this patent is extended or adjusted under 35 U.S.C. 154(b) by 0 days.

(21) Appl. No.: 10/177,481

(22) Filed: Jun. 21, 2002

(65) Prior Publication Data

US 2003/0046921 A1 Mar. 13, 2003

Related U.S. Application Data

(60) Provisional application No. 60/299,875, filed on Jun. 21, 2001.

(51) Int. Cl.[7] ..... F03H 3/00; H05H 1/00
(52) U.S. Cl. ..... 60/202; 60/203.1
(58) Field of Search ..... 60/202, 203.1

(56) References Cited

U.S. PATENT DOCUMENTS 3,032,978 A * 5/1962 Kunen ..... 60/202
3,041,824 A * 7/1962 Berhman ..... 60/203.1
3,071,705 A * 1/1963 Coleman et al. ..... 60/202
3,143,851 A * 8/1964 Nyman ..... 60/202
3,177,654 A * 4/1965 Gradecak ..... 60/202
3,209,189 A * 9/1965 Patrick ..... 313/231.31
3,321,664 A * 5/1967 Phillips et al. ..... 315/111.61
3,436,918 A * 4/1969 Brogan et al. ..... 376/319
3,505,550 A * 4/1970 Levoy et al. ..... 60/202
6,145,298 A * 11/2000 Burton, Jr. ..... 60/202
6,182,441 B1 * 2/2001 Hosick ..... 60/202
6,293,090 B1 * 9/2001 Olson ..... 60/203.1
6,449,941 B1 * 9/2002 Warboys et al. ..... 60/202

* cited by examiner

*Primary Examiner*—Ted Kim
(74) *Attorney, Agent, or Firm*—Inadiorio & Teska

(57) ABSTRACT

An air/atmosphere breathing electrically powered Hall effect thruster including a thruster duct having an inlet, an exit, and a discharge zone between the inlet and the exit for receiving air from the inlet into the discharge zone, an electrical circuit having a cathode for emitting electrons and an anode in the discharge zone for attracting the electrons from the cathode through the exit, and a magnetic circuit for establishing a magnetic field in the discharge zone radially across the duct between the anode and exit which creates an impedance to the flow of electrons toward the anode and enables ionization of the air/atmosphere moving through the discharge zone and which creates an axial electric field in the duct for accelerating ionized air/atmosphere through the exit to create thrust.

30 Claims, 7 Drawing Sheets

AIR BREATHING ELECTRICALLY POWERED HALL EFFECT THRUSTER

RELATED APPLICATIONS

This application claims priority of Provisional Application No. 60/299,875 filed Jun. 21, 2001, incorporated by reference herein.

FIELD OF THE INVENTION

This invention relates to an electrically powered air breathing plasma accelerator and more particularly to an electrically powered air breathing Hall effect thruster and more generally to such an electrically powered air breathing plasma accelerator, such as a Hall effect thruster, which is atmosphere breathing.

BACKGROUND OF THE INVENTION

The zone between approximately 80 kilometers and 160 kilometers above the earth, known as the E region of the ionosphere, is transited only by rockets and experimental hypersonic craft with specialized propulsion such as scramjets, and their combinations with rocket engines. Conventional spacecraft must operate well above an altitude of 160 kilometers to avoid drag induced re-entry. At altitudes greater than 30 kilometers above the earth, conventional aircraft cannot operate because of the lack of lift associated with the low pressure and insufficient oxygen in the thin atmosphere to combust fuel.

Spacecraft typically employ thrusters, such as Hall effect thrusters, to generate the required thrust for on-orbit maneuvering and repositioning. These thrusters require propellant stored on-board which limits the number of times the spacecraft can be maneuvered.

A typical prior art Hall thruster includes a propellant, a discharge chamber, an externally located cathode which emits electrons, an anode, located within the discharge chamber which attracts the electrons emitted from the cathode, and an electric circuit which energizes a magnet to create a radial magnetic field and a resulting axial electric field. The magnetic field presents an impedance to the flow of electrons from the emitter to the anode. As the electrons attempt to enter the discharge chamber, the magnetic field impedes the electrons and causes them to travel in a helical fashion about the magnetic field lines. The propellant, such as xenon, is introduced through a distributor into the discharge chamber. When the electrons trapped by the magnetic field collide with the propellant (e.g., xenon) they strip electrons from the propellant, creating positively charged ions. The positively charged ions are rapidly expelled from the discharge chamber due to the axial electric field and generate thrust.

Application of a prior art Hall thruster to maintain a vehicle for extended periods of time at altitudes below and 160 kilometers above the earth, in the ionosphere, or in the atmospheres of other planets, is impractical because extensive propellant must be stored on-board the vehicle to overcome drag. Storing sufficient propellant on-board the vehicle significantly increases the weight of the vehicle which increases the thrust requirements. This increased thrust requirement results in the need for a larger and heavier thruster, which consumes more power, thus requiring larger and generally heavier power sources. This causes further increases in the atmospheric drag of a vehicle employing the thruster as an engine leading to increased thrust requirements, more propellant and more electric power than can be provided by conventional on-board power generators, thus making it impossible to maintain the vehicle at the desired altitude.

Hence, there are no practical "atmospheric skimming" vehicles which can operate at the high altitude of the ionosphere and the low pressure, typically much less than 1 Torr, associated with this altitude, for extended periods of time.

SUMMARY OF THE INVENTION

It is therefore an object of this invention to provide an air breathing electrically powered plasma accelerator, such as Hall effect thruster.

It is a further object of this invention to provide such an air breathing electrically powered plasma accelerator, such as Hall effect thruster, which uses air or other ambient atmospheric gas as the propellant for the thruster.

It is a further object of this invention to provide such an air breathing electrically powered plasma accelerator, such as Hall effect thruster, which operates efficiently and effectively at an atmospheric pressure of less than 1 Torr.

It is a further object of this invention to provide such an air breathing electrically powered plasma accelerator, such as Hall effect thruster, which operates efficiently and effectively in the zone below 160 kilometers above the earth.

It is a further object of this invention to provide such an air breathing electrically powered plasma accelerator, such as Hall effect thruster, which operates efficiently and effectively in the ionosphere.

It is a further object of this invention to provide such an electrically powered plasma accelerator, such as Hall effect thruster, which operates efficiently and effectively where the atmospheric pressure is less than 1 Torr in the atmosphere of any planet.

It is a further object of this invention to provide such an air breathing electrically powered plasma accelerator, such as Hall effect thruster, which reduces or eliminates the need to store propellant for the thruster on-board a vehicle employing the thruster.

It is a further object of this invention to provide such an atmospheric breathing electrically powered plasma accelerator, such as Hall effect thruster, which efficiently and effectively uses solar arrays at ionospheric altitudes where the atmospheric drag is significantly reduced, to generate the electric power required by the thruster to generate sufficient thrust to maintain a vehicle employing the thruster at such altitudes for extended periods of time.

It is a further object of this invention to provide such an atmospheric breathing electrically powered plasma accelerator, such as Hall effect thruster, which can generate thrust for greatly extended periods of time.

It is a further object of this invention to provide such an air breathing electrically powered plasma accelerator, such as a Hall effect thruster, in which the energy input is electric rather than conventional combustible fuel.

It is a further object of this invention to provide such an atmospheric breathing electrically powered plasma accelerator, such as Hall effect thruster, which utilizes atomic oxygen and naturally occurring ions located in the upper atmosphere to improve the performance of the thruster.

This invention results from the realization that a truly effective atmospheric breathing electrically powered jet engine, in the form of a unique plasma accelerator, such as a Hall effect thruster, operable at ionospheric altitudes can be achieved by using the very atmosphere in which the thruster is located as the propellant eliminating the need for storing the propellant on-board and tapping into an endless supply of propellant and by the further realization that the electrical energy required to energize the ionize and accelerate the propellant and accelerate out of the thruster to create the thrust can be obtained from an on-board solar array and which may be sufficient given the reduced drag of the altitudes to maintain vehicles at the desired altitudes for an extended period of time.

This invention features an air breathing electrically powered plasma accelerator, such as a Hall effect thruster, including a thruster duct having an inlet, an exit, and a discharge zone between the inlet and the exit for receiving air from the inlet into the discharge zone. An electrical circuit has a cathode for emitting electrons and an anode in the discharge zone for attracting the electrons from the cathode through the exit. A magnetic circuit establishes a magnetic field in the discharge zone radially across the duct between the anode and exit which creates an impedance to the flow of electrons toward the anode and enables ionization of the air moving through the discharge zone and creates an axial electric field in the duct for accelerating ionized air through the exit to create thrust.

In a preferred embodiment, the electrical circuit may include a solar array source; the electrical circuit may include a battery or fuel cell. The air breathing electrically Hall effect thruster of this invention may include a screen at the inlet for repelling electrons emitted from the cathode. The screen may include a physical conductor at or below the voltage of the cathode; the screen may include a magnetic field across the inlet. The air breathing electrically powered Hall effect thruster may operate at a pressure less than 1 Torr, or at a pressure in the range of $10^{-4}$ to 1 Torr and altitudes in the range of 80 kilometers to 160 kilometers above the earth. In a preferred embodiment, the thruster operates in the ionosphere. The discharge zone may extend to define an increased dwell time for ionization. The discharge zone may include a plurality of magnetic circuits for establishing an extended magnetic field for increasing the dwell time.

This invention further features an atmospheric breathing electrically powered plasma accelerator, such as a Hall effect thruster, including a thruster duct having an inlet, an exit, and a discharge zone between the inlet and the exit for receiving atmospheric gas from the inlet into the discharge zone. An electrical circuit has a cathode for emitting electrons and an anode in the discharge zone for attracting the electrons from the cathode through the exit. A magnetic circuit establishes a radial magnetic field in the discharge zone across the duct between the anode and exit which creates an impedance to the flow of electrons toward the anode and enables ionization of the atmospheric gas moving through the discharge zone and creates an axial electric field in the duct for accelerating ionized atmospheric gas through the exit to create thrust.

This invention also features a high altitude low pressure electrically powered plasma accelerator, such as a Hall effect thruster, including a thruster duct having an inlet, an exit, and a discharge zone between the inlet and the exit for receiving air from the inlet into the discharge zone. An electrical circuit has a cathode for emitting electrons and an anode in the discharge zone for attracting the electrons from the cathode through the exit. A magnetic circuit establishes a magnetic field in the discharge zone across the duct between the anode and exit which creates an impedance to the flow of electrons toward the anode and enables ionization of the air moving through the discharge zone and which creates an axial electric field in the duct for accelerating ionized air through the exit to create thrust.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
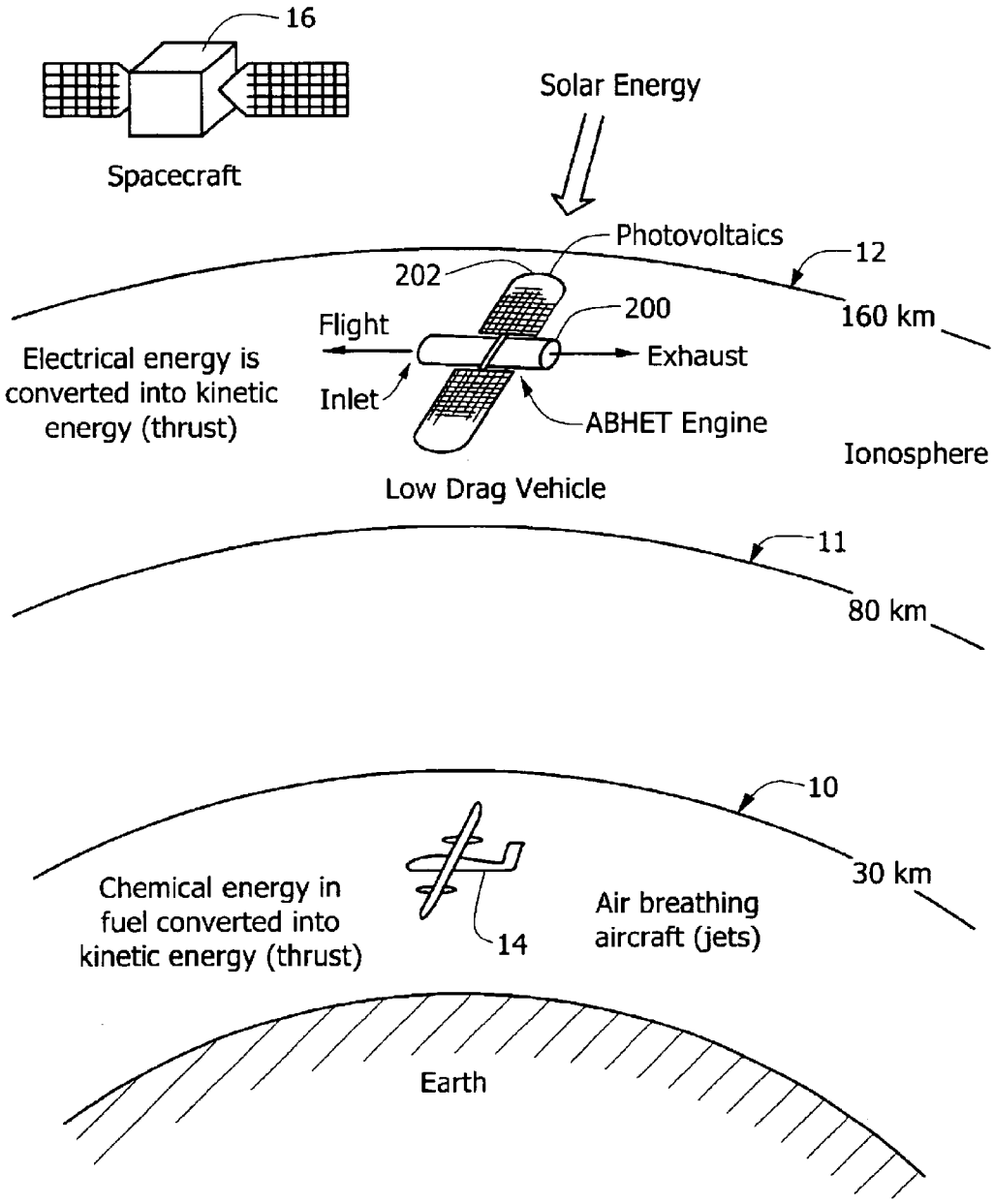
FIG. 1 is a three-dimensional view showing the various zones in which conventional aircraft, spacecraft, and the atmospheric breathing electrically powered Hall effect thruster of the subject invention operate.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings.

The zone between approximately 80 kilometers above the earth, indicated by arrow 11, FIG. 1 and 160 kilometers above the earth, indicated by arrow 12, known as the E region of the ionosphere, is transited only by rockets and experimental hypersonic craft with specialized propulsion such as ramjets, scramjets, and their combinations with rocket engines. Conventional spacecraft, such as spacecraft 16, must operate well above an altitude of 160 kilometers to avoid drag induced re-entry. At altitudes above 30 kilometers above the earth, indicated by arrow 10, conventional aircraft, such as aircraft 14 cannot operate because of the lack of lift associated with the low pressure and insufficient oxygen in the thin atmosphere to combust fuel.

Spacecraft typically employ thrusters to generate the required thrust for on-orbit maneuvering and repositioning. The spacecraft must store the propellant required for the thruster on-board the spacecraft which limits the number of times the spacecraft can be maneuvered.

Figure 2:
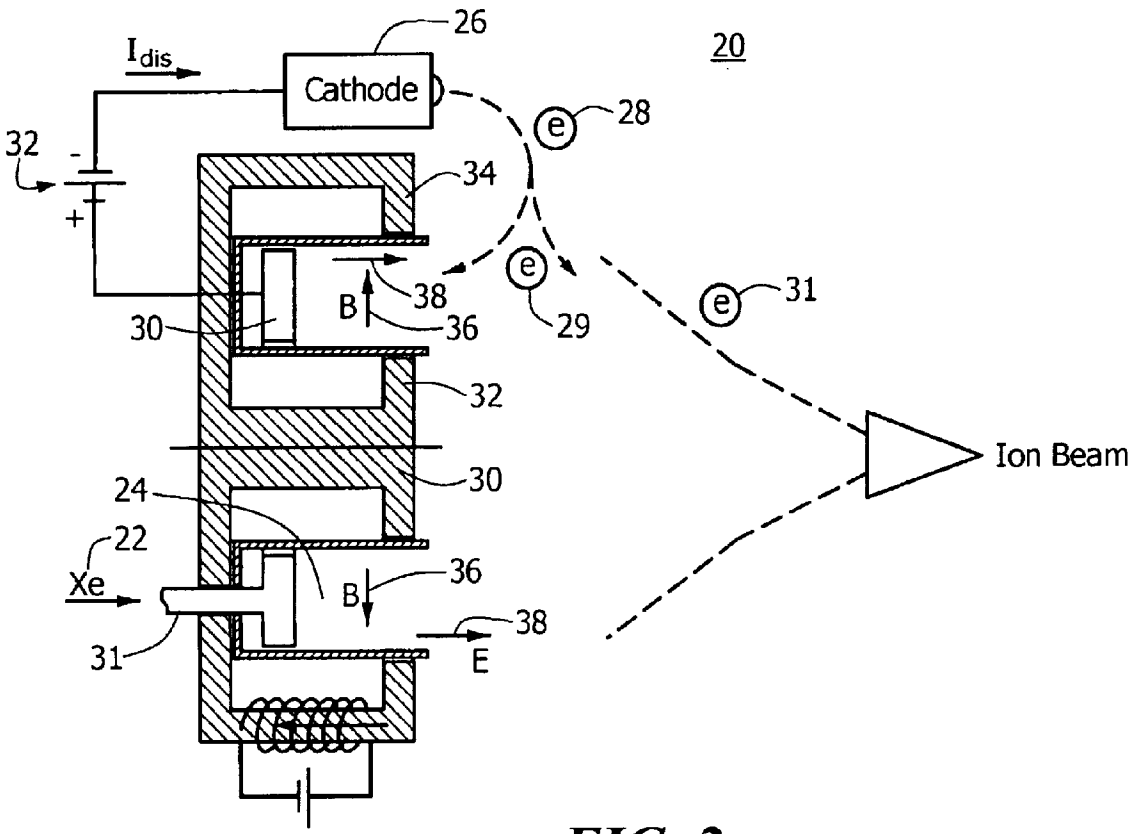
FIG. 2 PRIOR ART
FIG. 2 is a simplified, side-sectional, schematic diagram of a prior art Hall thruster.

A typical prior art thruster, such as Hall effect thruster 20, FIG. 2 includes propellant 22, such as xenon, discharge chamber 24, externally located cathode 26 which emits electrons, such as electrons 28, 29, and 31, anode 30 located within the discharge chamber 24 which attracts the electrons emitted from cathode 26, and an electric circuit 32 which energizes discharge in discharge chamber 24, typically annular in geometry, magnet 34, to create radial magnetic field 36 and resulting axial electric field 38. Magnetic field 36 presents an impedance to the flow of electrons toward anode 30 forcing the electrons to travel in a helical fashion about the magnetic field lines associated with magnetic field 36, as shown by arrow 42, FIG. 3. Propellant 22, FIG. 2 is introduced through propellant distributor 31 in discharge chamber 24.

Figure 3:
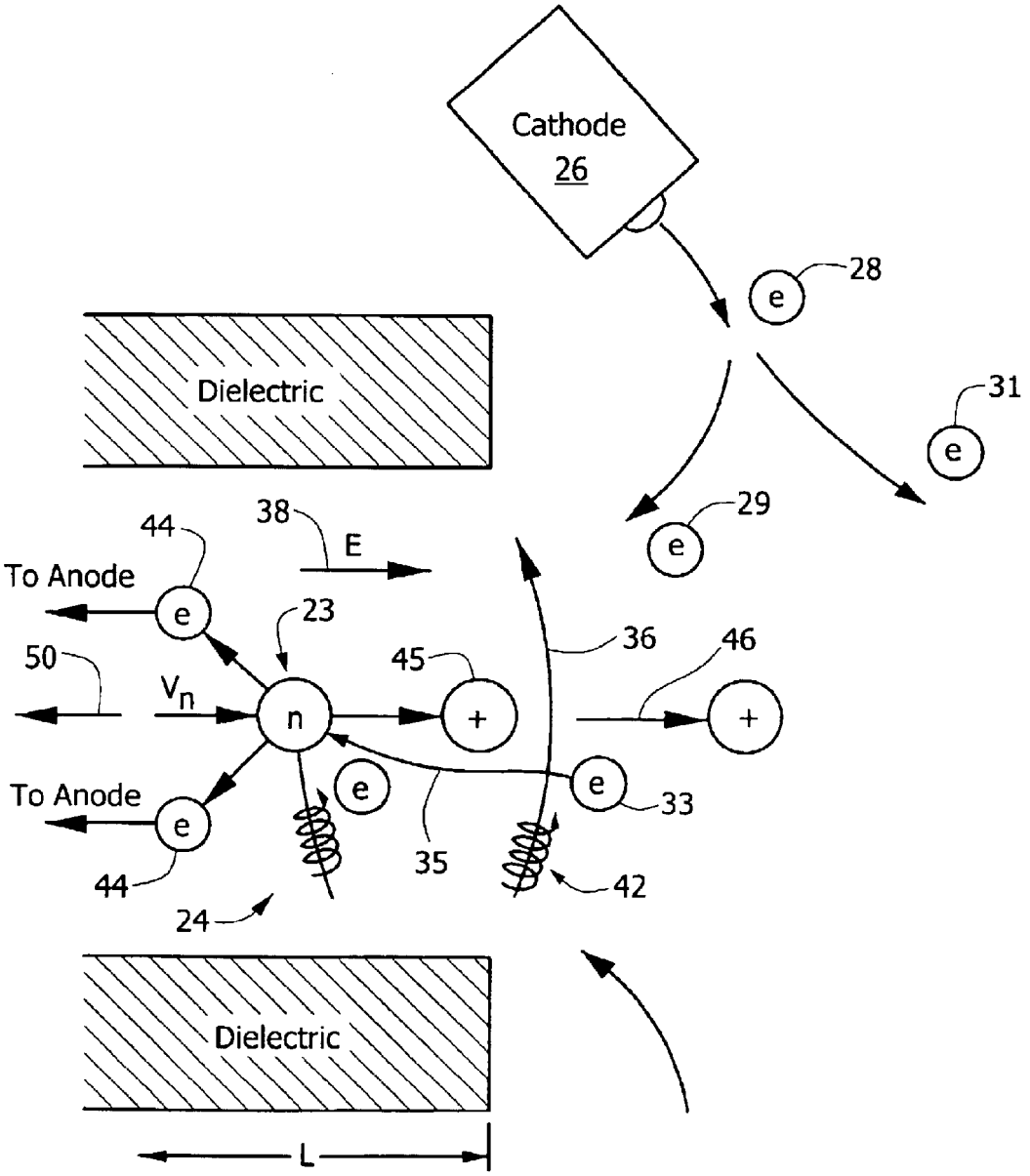
FIG. 3 PRIOR ART
FIG. 3 is an enlarged view of a portion of the prior art thruster of FIG. 2 illustrating the ionization of the propellant by electron impact and the interaction of the magnetic and electric field that accelerates the propellant.

When the electrons trapped by magnetic field 36, FIG. 3 collide with propellant atom, such as atom 23 they create positively charged ions. The positively charged ions are rapidly expelled from discharge chamber 24 due to axial electric field 38 indicated by arrow 46 to generate thrust in the direction indicated by arrow 50. For example, when electron 33 on magnetic field line 36 collides with propellant atom 23, as indicated by arrow 35, the collision strips one of the electrons, such as electron 44 from propellant atom 23, to create positively charged ion 45 which is expelled from discharge chamber 24 by axial electric field 38 to generate thrust.

Application of prior art Hall thruster 20 to maintain a vehicle for extended periods of time in the zone between 80 kilometers and 160 kilometers above the earth, i.e., in the ionosphere, or in the atmospheres of other planets, is impractical because extensive propellant must be stored on board the vehicle. The increased weight associated with storing propellant on-board the vehicle increases the thrust requirement to maintain the vehicle in flight. The increased thrust requirement results in the requirement for a larger and heavier thruster and an increase in required electrical power which in turn requires a larger, heavier vehicle. The result is a further increase in the thrust requirements due to the increased aerodynamic drag associated with the larger vehicle which increases in the electrical energy requirements. The increased electrical energy requirements result in the inability to use conventional on-board power sources, such as solar cells, to provide sufficient electrical energy to maintain the vehicle at the desired altitudes.

Figure 4A:
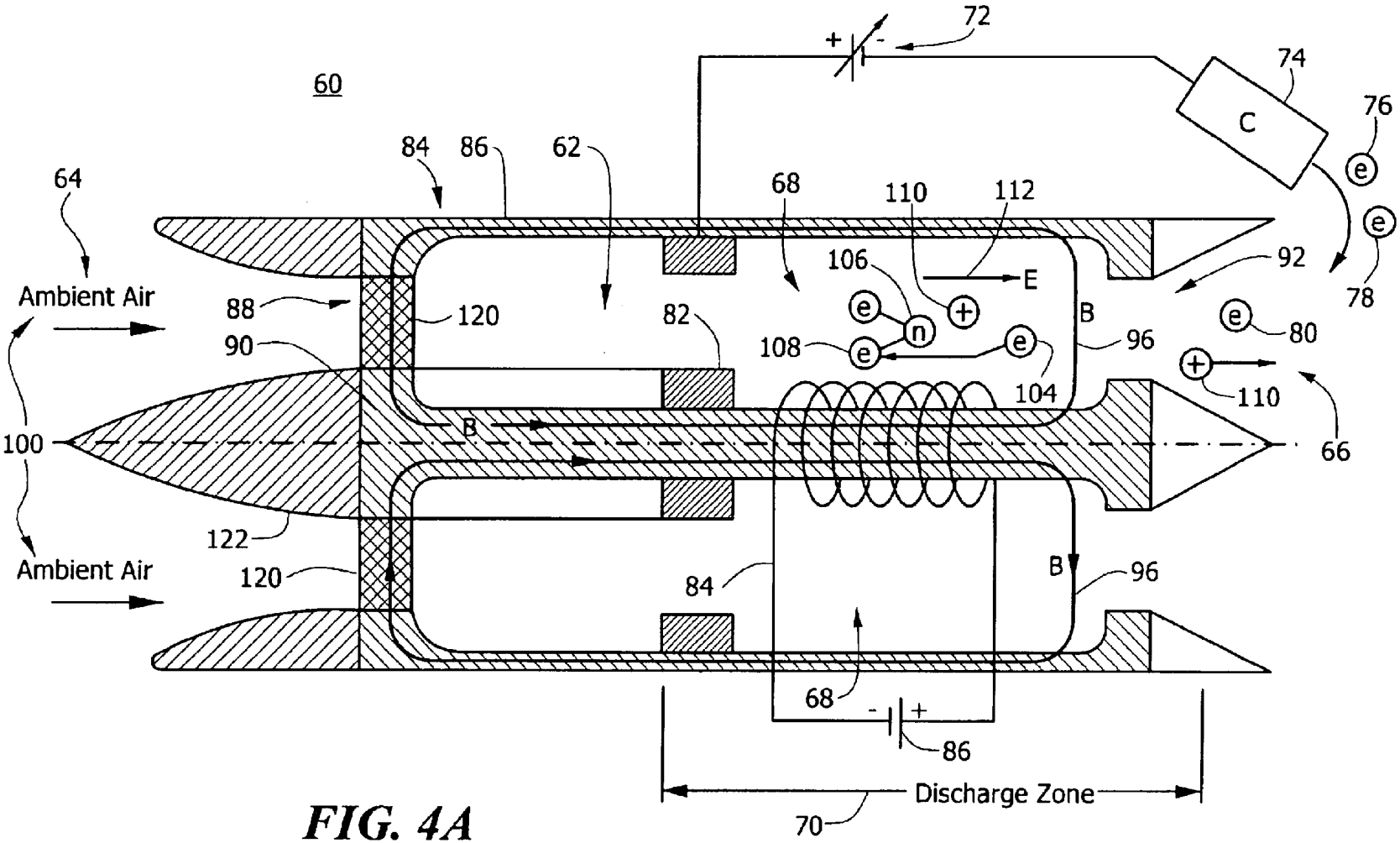
FIG. 4A is a side-sectional schematic diagram of one embodiment of an electrically powered air breathing Hall effect thruster in accordance with the subject invention.
Figure 4B:
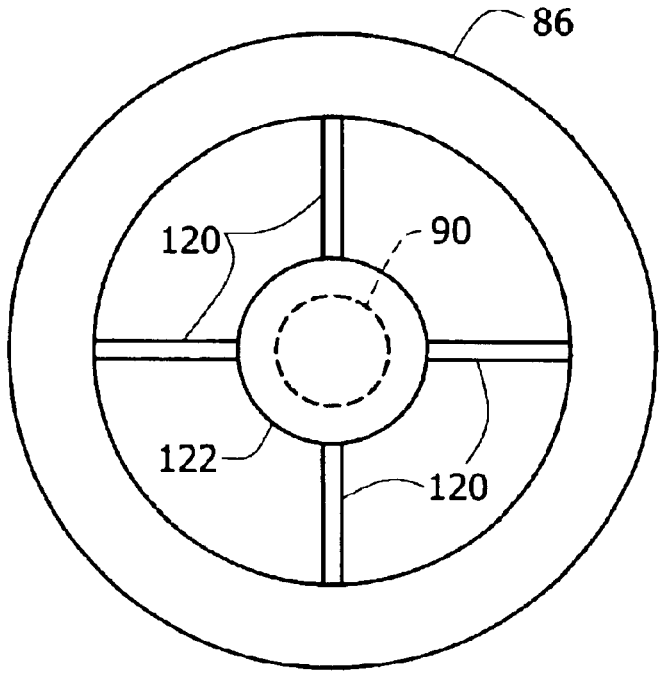
FIG. 4B is a schematic end-view of the electrically powered air breathing Hall effect thruster of FIG. 4A.

In contrast, air breathing, electrically powered plasma accelerator, such as air breathing electrically powered Hall effect thruster 60, FIG. 4A of the subject invention, in one embodiment, includes thruster duct 62 having inlet 64, exit 66 and discharge zone 68, located between inlet 64 and exit 66, for receiving air from the inlet 64 into the discharge zone 68. In one design, discharge zone 68 spans the region of duct 62 as indicated by arrow 70. Ideally, inlet 64 is contoured for very low density (e.g., less than 1 Torr), high speed air flow (e.g., in the range of 7.5 km/s) using rarefied gas dynamics design techniques known to those skilled in the art. Air breathing electrically powered Hall effect thruster 60 further includes electric circuit 72 having cathode 74 for emitting electrons, such as electrons 76, 78, and 80, anode 82, located within discharge zone 68, for attracting electrons emitted from cathode 74 through exit 66, and magnetic circuit 84 for establishing a magnetic field 96 (B) within discharge zone 68 and across duct 62 between anode 82 and exit 66. Magnetic field 96 creates an impedance to the flow of electrons (e.g., electrons 76, 78, and 80) to anode 82 and causes the electrons to travel in a helical fashion about the magnetic field lines (not shown) produced by magnetic field 96, similar to prior art Hall thruster 20 described above. Magnetic circuit 84 enables ionization of ambient air 100 moving through discharge zone 68 when the electrons impeded by magnetic field 96, for example, electron 104, on the magnetic field lines created by magnetic field 96 and collide with air molecules or atoms, such as oxygen atom 106, and strip an electron, such as electron 108, from oxygen atom 106 to create a positively charged oxygen ion, such as ion 110. Electrons drifting across the magnetic field 96 create an axial electric field 112 (E) in duct 62 which accelerates ionized air, e.g., positively charged ion 110, to exit 66 to create thrust. Magnetic circuit 84, in one design, includes outer magnetic core 86, gap 88, inner magnetic core 90 and gap 92. Typically, magnetic core 86 and magnetic core 90 are annular as shown in FIG. 4B and composed of a ferromagnetic material. In one embodiment, the source of magnetic field 96 may be electromagnetic coil 84 which may be powered by a separate power source 86 or it may be connected in series with the anode 82 and the cathode 74. Ideally thruster 60 includes struts 120, which may be magnetic or non-magnetic to secure body 122 in place.

Although as described above, electrically powered Hall effect thruster 60 is air breathing, in other preferred embodiments, thruster 60 is atmospheric breathing and may be used on any planet where at some altitude there is atmospheric pressure less than 1 Torr.

The robust design of air breathing electrically powered plasma acceleration, such as air breathing electrically powered Hall effect thruster 60 in accordance with this invention with unique thruster duct 62 including inlet 64 designed to receive air and the ability to ionize this air eliminates the need to store propellant on-board any vehicle employing air breathing thruster 60 as an engine. Because the need to store on-board propellants is reduced or eliminated the overall weight and size of a vehicle employing innovative air breathing electrically powered Hall effect thruster 60 as an engine is significantly reduced which leads to a reduction in the aerodynamic drag and lift requirements of the vehicle and hence a reduction of thrust requirement. The reduced thrust requirement reduces the size of the required electromagnet 84 and the electric power source in electric circuit 72 to ionize the propellant and expel it at high speed through exit 66 to generate thrust. This reduces the size and weight of the vehicle and its aerodynamic drag, further reducing the electrical power requirements of electric circuit 72. Because the electrical power requirements are reduced, as is the atmospheric drag, any vehicle employing thruster 60, such as vehicle 200, FIG. 1 may be able to obtain electrical energy from on-board solar arrays, such as photovoltaics 202. In other designs, the electrical energy for electric circuit 72, FIG. 4A, may be obtained from other power sources such as a battery (not shown) or a fuel cell.

Because the propellant is supplied by the very atmosphere where vehicle 200, FIG. 1 is traveling, e.g., the ionosphere, robust air breathing electrically powered Hall effect thruster 60, FIG. 4A, in accordance with this invention can generate thrust for greatly extended periods of time, such as a year or more. Moreover, in the zone 80 kilometers above the earth, i.e., the ionosphere, there is a significant presence of atomic oxygen and naturally occurring ions. Atomic oxygen, when used as a propellant increases the performance of thruster 60 because atomic oxygen is not bonded to another oxygen forming a molecule and its electrons can be more easily removed than atomic oxygen to create a positively charged ion.

Figure 5:
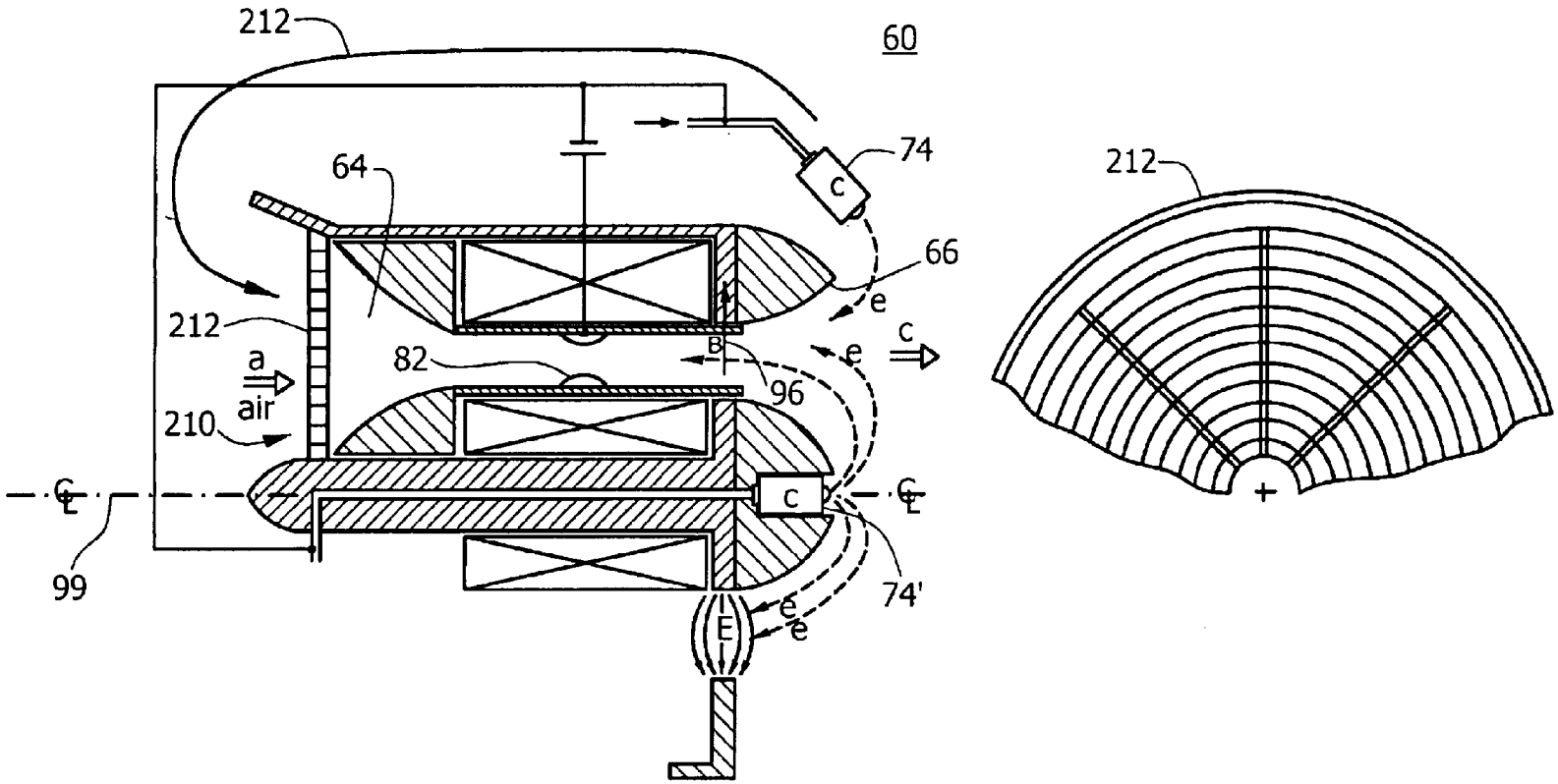
FIG. 5 is a detailed view of the electrically powered air breathing Hall effect thruster of FIG. 4A showing one alternative mechanical/electrical or magnetic screen for repelling cathode electrons from the input of the thruster.

In one embodiment of this invention, air breathing electrically powered Hall effect thruster 60, FIG. 5 includes screen 210 at inlet 64 for repelling electrons emitted from cathode 74. In one design, screen 210 is a physical screen, such as screen 212 of perforated metal with the maximum possible open area fraction and individual holes smaller than the local Debye length. In other designs, screen 210 may include a physical conductor (not shown) at or below the voltage of cathode 74 which repels electrons. In other examples, screen 210 ay be a magnetic field at inlet 64 such that the resulting local plasma impedance is much 24 eater than at exit 66. Screen 210 prevents electrons originating from externally located cathode 74 from entering thruster 50 at inlet 64. Without screen 210 the electrons emitted from cathode 74 may prefer the path from cathode 74 to inlet 64, indicated by arrow 212, especially during discharge initiation because magnetic field 96 applied near exit 66 represents a large impedance to the flow of electrons towards anode 82. Center line 99 runs through cathode 74'.

Ideally, air breathing electrically powered Hall effect thruster 60 operates at a pressure less than 1 Torr. In one embodiment, thruster 60 operates at a pressure in the range of $10^{-4}$ to 1 Torr. Typically, thruster 60 operates at altitudes between 80 kilometers and 160 kilometers above the earth. In one preferred embodiment, thruster 60 operates in the ionosphere.

Figure 6:
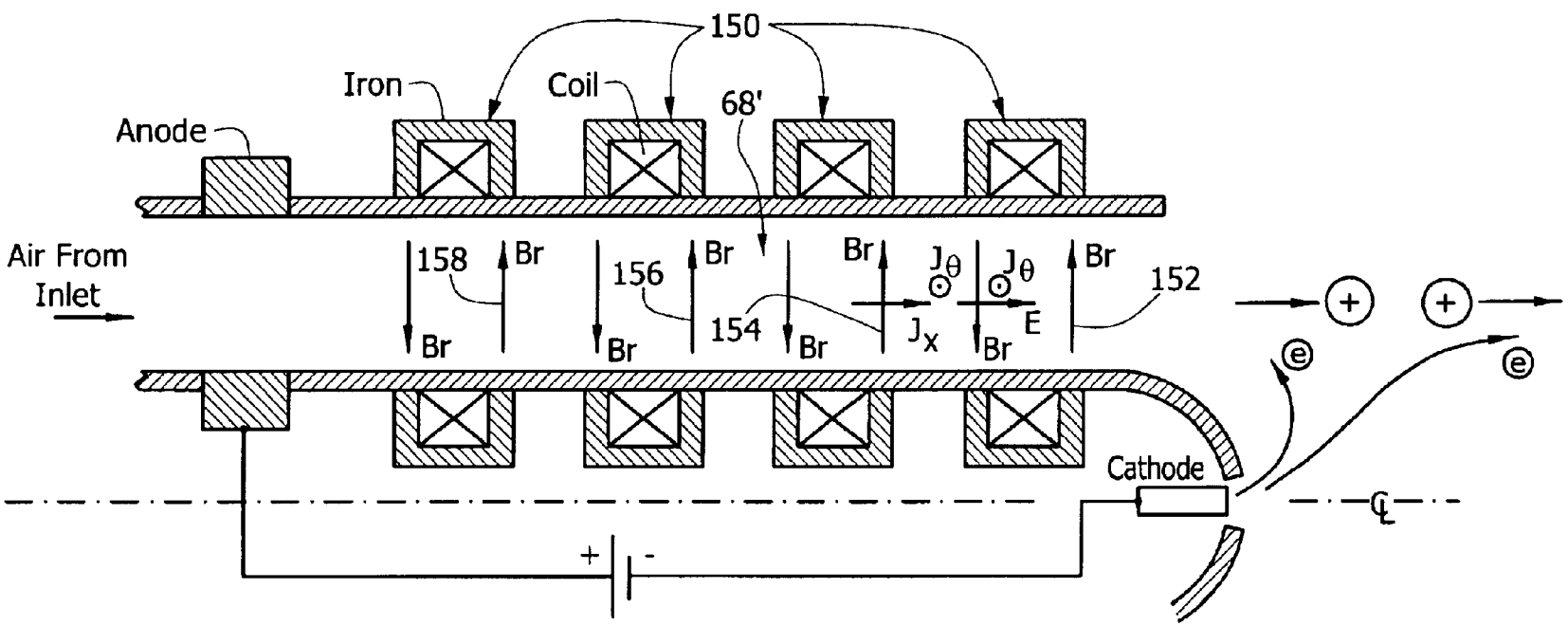
FIG. 6 is a schematic cross-sectional view of a multistage electrically powered Hall effect thruster of FIG. 4A showing a number of electromagnets to establish an extended magnetic/electric field area to increase the propellant ionization and acceleration length in the discharge zone.

In one design, electrically powered Hall effect thruster 60 includes a discharge zone which is extended to achieve an increased dwell time for ionization. For example, if the required ionization time is 100 microseconds and the air enters the thruster at 7,500 m/sec, the required discharge chamber length is at least 0.75 m. As shown in FIG. 6, discharge zone 68' includes a plurality of magnetic circuits 150 for establishing an extended magnetic field, e.g., magnetic fields 152, 154, 156, and 158, for increasing the dwell time of air or atmospheric gas moving through the discharge zone at high velocities which results in an increase in the ionization of the air or atmospheric gas, hence increasing the thrust capacity of thruster 60.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. An air breathing electrically powered Hall effect thruster comprising:

a thruster duct having an inlet, an exit, and a discharge zone between said inlet and said exit for receiving air from the inlet into the discharge zone;

an electrical circuit having a cathode for emitting electrons and an anode in said discharge zone for attracting the electrons from said cathode through the exit;

a magnetic circuit for establishing a radial magnetic field in said discharge zone across the duct between the anode and exit which creates an impedance to the flow of electrons toward the anode and enables ionization of the air moving through the discharge zone and which creates an axial electric field in said duct for accelerating ionized air through the exit to create thrust; and a screen at the inlet for repelling electrons emitted from said cathode.

2. The air breathing electrically powered Hall effect thruster of claim 1 in which said electrical circuit includes a solar array source.

3. The air breathing electrically powered Hall effect thruster of claim 1 in which said electrical circuit includes a battery.

4. The air breathing electrically powered Hall effect thruster of claim 1 in which said screen includes a physical conductor at or below the voltage of said cathode.

5. The air breathing electrically powered Hall effect thruster of claim 1 in which said screen includes a magnetic field across said inlet.

6. The air breathing electrically powered Hall effect thruster of claim 1 in which thruster operates at a pressure less than 1 Torr.

7. The air breathing electrically powered Hall effect thruster of claim 1 in which the thruster operates at a pressure in the range of $10^{-4}$ to 1 Torr.

8. The air breathing electrically powered Hall effect thruster of claim 1 in which the thruster operates at altitudes in the range of 80 kilometers to 160 kilometers above the earth.

9. The air breathing electrically powered Hall effect thruster of claim 1 in which said thruster operates in the ionosphere.

10. The air breathing electrically powered Hall effect thruster of claim 1 in which said discharge zone is extended to achieve an increased time for ionization.

11. The air breathing electrically powered Hall effect thruster of claim 10 in which said discharge zone includes a plurality of magnetic circuits for establishing an extended magnetic field for increasing said dwell time.

12. The air breathing electrically powered Hall effect thruster of claim 1 in which said inlet is contoured for an air density of less than 1 Torr and air speed up to 8 km/sec.

13. An atmosphere breathing electrically powered Hall effect thruster comprising:

a thruster duct having an inlet, an exit, and a discharge zone between said inlet and said exit for receiving atmospheric gas from the inlet into the discharge zone;

an electrical circuit having a cathode for emitting electrons and an anode in said discharge zone for attracting the electrons from the cathode through the exit;

a magnetic circuit for establishing a radial magnetic field in said discharge zone across the duct between the anode and exit which creates an impedance to the flow of electrons toward the anode and enables ionization of the atmospheric gas moving through the discharge zone and which creates an axial electric field in said duct for accelerating ionized atmospheric gas through the exit to create thrust; and a screen at the inlet for repelling electrons emitted from said cathode.

14. A high altitude low pressure electrically powered Hall effect thruster comprising:

a thruster duct having an inlet, an exit, and a discharge zone between said inlet and said exit for receiving air from the inlet into the discharge zone;

an electrical circuit having a cathode for emitting electrons and an anode in said discharge zone for attracting the electrons from the cathode through the exit;

a magnetic circuit for establishing a radial magnetic field in said discharge zone across the duct between the anode and exit which creates an impedance to the flow of electrons toward the anode and enables ionization of the air moving through the discharge zone and which creates an axial electric field in said duct for accelerating ionized air through the exit to create thrust; and a screen at the inlet for repelling electrons emitted from said cathode.

15. An air breathing electrically powered plasma accelerator comprising:

a thruster duct having an inlet, an exit, and a discharge zone between said inlet and said exit for receiving air from the inlet into the discharge zone;

an electrical circuit having a cathode for emitting electrons and an anode in said discharge zone for attracting the electrons from said cathode through the exit;

a magnetic circuit for establishing a radial magnetic field in said discharge zone across the duct between the anode and exit which creates an impedance to the flow of electrons toward the anode and enables ionization of the air moving through the discharge zone and which creates an axial electric field in said duct for accelerating ionized air through the exit to create thrust; and a screen at the inlet for repelling electrons emitted from said cathode.

16. The air breathing electrically powered plasma accelerator of claim 15 in which said electrical circuit includes a solar array source.

17. The air breathing electrically powered plasma accelerator of claim 16 which said electrical circuit includes a battery.

18. The air breathing electrically powered plasma accelerator of claim 15 in which said screen includes a physical conductor at or below the voltage of said cathode.

19. The air breathing electrically powered plasma accelerator of claim 15 which said screen includes a magnetic field across said inlet.

20. The air breathing electrically powered plasma accelerator of claim 15 in which said thruster operates at a pressure less than 1 Torr.

21. The air breathing electrically powered plasma accelerator of claim 15 in which the thruster operates at a pressure in the range of $10^{-4}$ to 1 Torr.

22. The air breathing electrically powered plasma accelerator of claim 15 in which the thruster operates at altitudes in the range of 80 kilometers to 160 kilometers above the earth.

23. The air breathing electrically powered plasma accelerator of claim 15 in which the thruster operates in the ionosphere.

24. The air breathing electrically powered plasma accelerator of claim 15 in which said discharge zone is extended to define an increased time for ionization.

25. The air breathing electrically powered plasma accelerator of claim 24 in which said discharge zone includes a plurality of magnetic circuits for establishing an extended magnetic field for increasing said dwell time.

26. The air breathing electrically powered plasma accelerator of claim 15 in which said inlet is contoured for an air density of less than 1 Torr and air speed up to 9 m/s.

27. An atmosphere breathing electrically powered plasma accelerator comprising:

a thruster duct having an inlet, an exit, and a discharge zone between said inlet and said exit for receiving atmospheric gas from the inlet into the discharge zone;

an electrical circuit having a cathode for emitting electrons and an anode in said discharge zone for attracting the electrons from said cathode through the exit;

a magnetic circuit for establishing a radial magnetic field in said discharge zone across the duct between the anode and exit which creates an impedance to the flow of electrons toward the anode and enables ionization of the atmospheric gas moving through the discharge zone and which creates an axial electric field in said duct for accelerating ionized atmospheric gas through the exit to create thrust; and a screen at the inlet for repelling electrons emitted from said cathode.

28. A high altitude low pressure electrically powered plasma accelerator comprising:

a thruster duct having an inlet, an exit, and a discharge zone between said inlet and said exit for receiving air from the inlet into the discharge zone;

an electrical circuit having a cathode for emitting electrons and an anode in said discharge zone for attracting the electrons from the cathode through the exit;

a magnetic circuit for establishing a radial magnetic field in said discharge zone across the duct between the anode and exit which creates an impedance to the flow of electrons toward the anode and enables ionization of the air moving through the discharge zone and which creates an axial electric field in said duct for accelerating ionized air through the exit to create thrust; and a screen at the inlet for repelling electrons emitted from said cathode.

29. An air breathing electrically powered Hall effect thruster comprising:

a thruster duct having an inlet, an exit, and a discharge zone between said inlet and said exit for receiving air from the inlet into the discharge zone, said inlet is contoured for an air density of less than 1 Torr and air speed up to 8 km/sec;

an electrical circuit having a cathode for emitting electrons and an anode in said discharge zone for attracting the electrons from said cathode through the exit; and a magnetic circuit for establishing a radial magnetic field in said discharge zone across the duct between the anode and exit which creates an impedance to the flow of electrons toward the anode and enables ionization of the air moving through the discharge zone and which creates an axial electric field in said duct for accelerating ionized air through the exit to create thrust.

30. An air breathing electrically powered plasma accelerator comprising:

a thruster duct having an inlet, an exit, and a discharge zone between said inlet and said exit for receiving air from the inlet into the discharge zone, said inlet contoured for an air density of less than 1 Torr and air speed up to 9 m/s;

an electrical circuit having a cathode for emitting electrons and an anode in said discharge zone for attracting the electrons from said cathode through the exit; and a magnetic circuit for establishing a radial magnetic field in said discharge zone across the duct between the anode and exit which creates an impedance to the flow of electrons toward the anode and enables ionization of the air moving through the discharge zone and which creates an axial electric field in said duct for accelerating ionized air through the exit to create thrust.

* * * * *